US005874898A

United States Patent [19]

Peralta et al.

[11] Patent Number: 5,874,898

[45] Date of Patent: Feb. 23, 1999

[54] DETECTOR FOR OBJECTS FALLING INTO WATER

[76] Inventors: Joaquin O. Peralta; Maria Teresa Casas De Peralta, both of Constitucion 339, 4200 Santiago del Estero, Argentina

[21] Appl. No.: 5,958

[22] Filed: Jan. 9, 1998

[51] Int. Cl.[6] ..... G08B 21/00

[52] U.S. Cl. ..... 340/573.6; 340/552; 340/556; 340/693; 367/93

[58] Field of Search ..... 340/556, 557, 340/552, 540, 693, 573, 541; 367/93

[56] References Cited

U.S. PATENT DOCUMENTS 4,747,085 5/1988 Dunegan et al. ..... 340/573
5,023,593 6/1991 Brox ..... 340/540
5,541,403 7/1996 Heinonen et al. ..... 340/556
5,638,048 6/1997 Curry ..... 340/573

*Primary Examiner*—Glen Swann
*Attorney, Agent, or Firm*—Lahive & Cockfield, LLP

[57] ABSTRACT

Apparatus for detecting the fall of a person or object into a body of water comprises a series of interconnected modules mounted in a line contiguous to the body, and associated controls. The modules comprise alternately disposed radiation emitters and radiation sensors. The controls are associated with the sensors and adapted to detect perturbations from a steady state condition of the received radiation energy caused by reflections from the falling person or object.

8 Claims, 3 Drawing Sheets

DETECTOR FOR OBJECTS FALLING INTO WATER

BACKGROUND OF THE INVENTION

This invention relates generally to apparatus for detecting the fall or immersion of a person or object into a body of water. More particularly, it relates to apparatus for sounding an alarm in the case of a sudden or accidental fall of a person or object into a swimming pool or other body of water, or a more gradual sinking into the water.

Devices previously proposed for such use comprise a sensor located on the water surface or on a confining wall, whereby the sensor is operative over a limited area adjacent the device. A drawback of such devices is that their utility and reliability are localized and do not include the whole perimeter and area of the swimming pool or other water body. The degree of effectiveness of the device therefore depends on the water area.

An object of the present invention is to provide detection and alarm apparatus that is effective and reliable for any water area.

A very significant and frequently the most important safety hazard in swimming pools is the fall of a child or other person from the side of a swimming pool, which may occur at any point around the perimeter. It is a second object of this invention to provide detection and alarm means that are equally effective and reliable to sound an alarm and locate the place of an accidental fall from any point around the perimeter of a pool of any size, shape or area.

A further object is to detect accidental falls, whether sudden or resulting from slow movement as in the case of a sinking person.

BRIEF SUMMARY OF THE INVENTION

With the foregoing and other objects hereinafter appearing in view, the features of this invention include a strip comprising a series of interconnected modules mounted along a line contiguous to the body of water. The modules comprise both radiation emitters and radiation sensors disposed in an alternating sequence. Each emitter emits radiation energy over an area of the body of water, and each radiation sensor is adapted to receive radiation energy from the body in said area. Responsive means are operatively connected to each of the radiation sensors and adapted to assume a steady state condition caused by received radiation energy arising in the absence of any object falling into or beneath the surface of the water. In the presence of an object falling into or sinking below the water surface, the received energy undergoes a perturbation, such as a change in magnitude, resulting from radiation energy reflected from the object to one or more sensors. Control means are provided with a comparator adapted to detect the presence of a significant perturbation from the steady state condition, and to produce an alarm or other form of detection signal.

By the foregoing means, a scanning device is provided which functions as a protective fence around the swimming pool or other body of water.

DETAILED DESCRIPTION

In the following description like reference numbers are used in the several figures to represent the same or corresponding parts.

Figure 1:
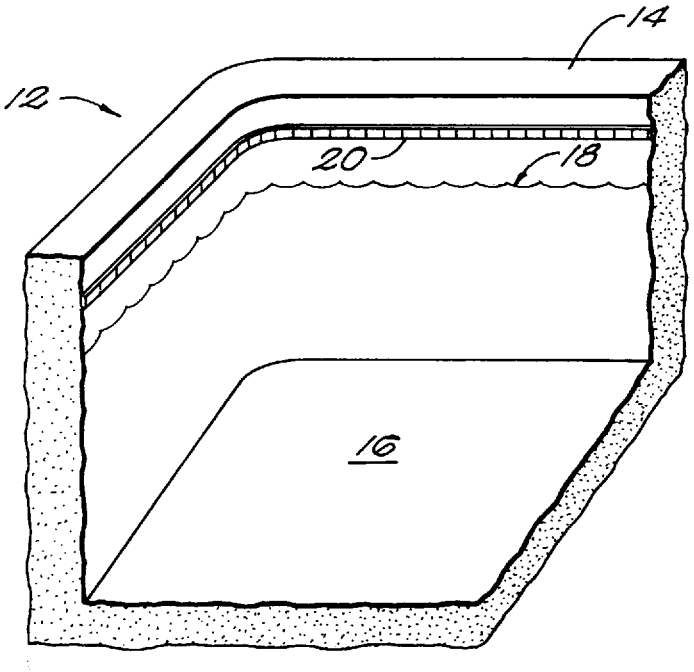
FIG. 1 is a fragmentary view of a swimming pool having a series of modules mounted along its wall in accordance with a first embodiment of the invention.
Figure 6:
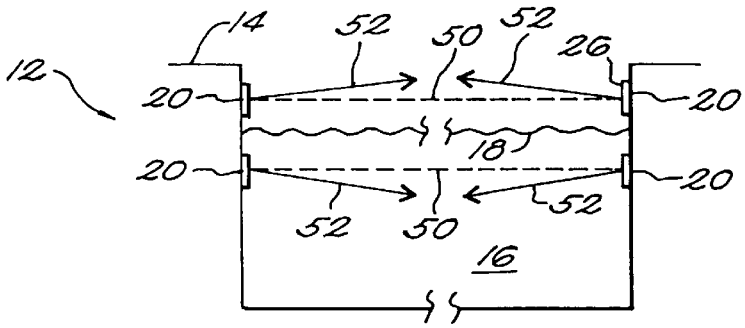
FIG. 6 is an illustration showing the preferred angular relationships of directional emitters on opposing walls of a swimming pool.

Referring to FIG. 1, a swimming pool 12 has a wall 14 and contains a body of water 16 having a surface 18. A strip or belt 20 of interconnected modular units according to this invention is suitably fixed, attached to or mounted on the wall 14 above the surface 18. Alternatively, the strip 20 can be mounted on the wall 14 below the surface 18 as shown in FIG. 6.

Figure 2:
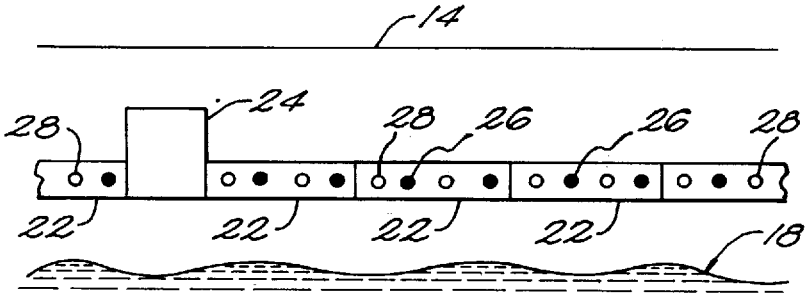
FIG. 2 is a fragmentary schematic elevation of a portion of the swimming pool wall showing details of the modules.

FIG. 2 schematically illustrates a presently preferred embodiment of the invention comprising a series of identical modules 22 electrically connected together. Each module is elongate in form having a preferred length of approximately one-half meter. The modules are connected completely around the perimeter of the pool, and are connected to a control unit 24 which may be, for example, a microcontroller configured as hereinafter more fully described.

Each of the modules 22 comprises emitters 26 represented in the drawing by darkened circles and radiation sensors 28 represented by open circles, the emitters and sensors being disposed in alternating sequence. However, it will be apparent from the following description that an alternating sequence of emitters and sensors can be achieved by a different embodiment, for example one having two kinds of modules, namely an emitter module having only one or more emitters 26 and a sensor module having only one or more sensors 28. In that case the emitter and sensor modules are mounted alternately in the strip 20.

The emitters 26 are each adapted to emit radiation energy over the adjacent area of the body 16 of water toward which it faces, the radiation energy being the most intense at and around the pool edge nearest to the emitter.

The emitters 26 emit periodic pressure waves in the acoustic or ultrasonic range, or periodic electromagnetic waves, or intermittent pulses of infrared energy, and the sensors 28 are adapted to sense the corresponding form of radiation energy impinging thereon.

Figure 3:
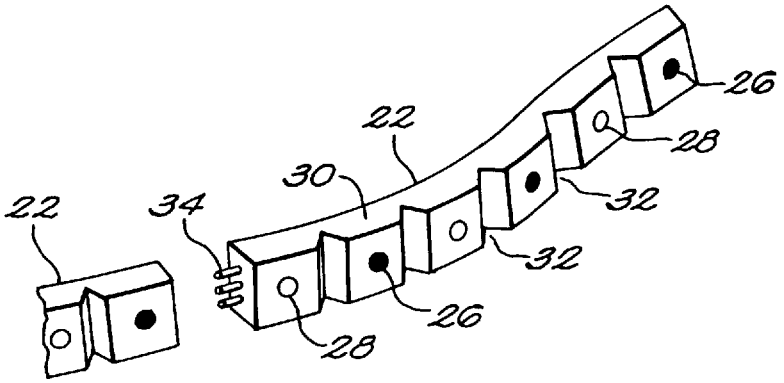
FIG. 3 is an illustration of one form of module body including means for interconnecting the modules.

FIG. 3 illustrates one form of module 22 comprising three emitters 26 and three sensors 28, mounted on a body 30 of waterproof material having wedge-shaped recesses 32 to provide flexibility so that the body can be adapted to any curved swimming pool wall. Electrical plug and socket connectors 34 are located respectively on the ends of each module and interconnect the modules one after the other in series about the perimeter of the pool, each module being connected to the next by the connectors 34 which are adapted for waterproof connection.

Figure 4:
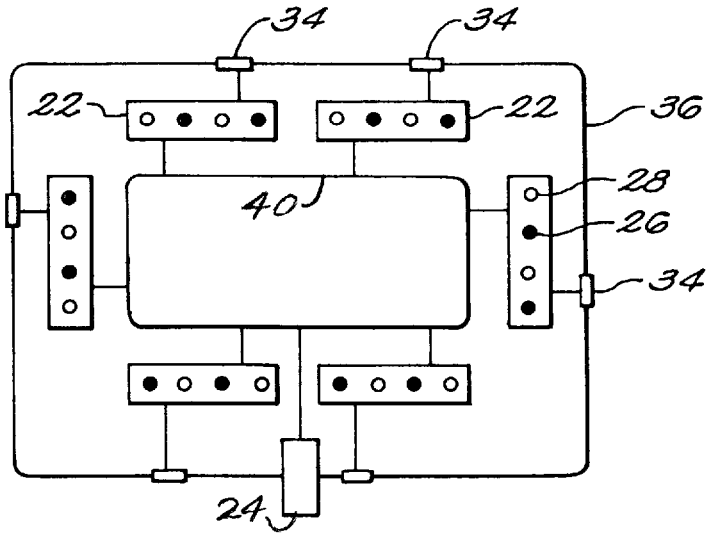
FIG. 4 is a schematic illustration of a plurality of modules showing their connection with a control unit.

FIG. 4 schematically illustrates one form of electrical connections between the elements of the system. A strip 20 of six modules 22 in series connection is shown. A circuit 36 extends from the control unit 24 through pins on the connectors 34 on each end of each module and back to the control unit. Within each module the continuity of this circuit between these pins can be closed or broken by a single pole, single throw switch 38 described below with reference to FIG. 5. Each of the switches 38 is normally closed, and the control unit includes means for detecting a break in the continuity of the circuit 36. Circuit means within each module are provided to open its switch 38 if the radiation received by its sensor or sensors has a perturbation of sufficient magnitude to indicate that a person or object is reflecting the radiation.

An open circuit in a particular module at any time is detected by the control unit 24. In response, the control unit generates a clock signal on a circuit 40 which, in combination with the open circuit condition in the particular module, provides the means for identifying that module electronically and thereby permitting the location of the person or object in relation to the perimeter of the swimming pool. In a case, for example, where the switches in all modules are opened, this may be detected to indicate a false alarm.

The circuit 36 is connected to the positive terminal of a battery (not shown) located in the control unit 24, and the circuit 40 is connected to the negative terminal of the battery. Each of the sensors 28 in each module 22 is connected between the circuits 36 and 40.

It will be understood that FIG. 4 is schematic, and that the circuits 36 and 40 are actually encased within the bodies 30 of the respective modules and extend through individual pins on the connectors 34 (FIG. 3). The connectors 34 are thus represented schematically in FIG. 4.

Suitable circuits of known form (not shown) are provided for energizing the emitters 26 in the modules with a source of continuous electrical energy at a predetermined frequency or frequencies, whereby radiation energy is continuously emitted from the entire perimeter of the strip 20 into the body 16 of water.

In use, the sensors 28 display an impedance characteristic representing the received radiation energy. A responsive circuit in each module 22 is connected to the sensors and assumes a "normal" or "steady state" condition when no object is at, near or beneath the surface 18 of the body of water. This comprises the "safe" condition of the responsive circuit. In the event that a person or other object falls into or sinks beneath the surface of the body of water at any location, particularly a location in the near vicinity of the wall 14 anywhere around its perimeter, one or more sensors 28 change their impedances or other characteristics in the responsive circuit, as a result of reflections of radiation energy from the person or object. These departures or perturbations are detected by a comparator 42 of a known and conventional type, described below with reference to FIG. 5, which compares the steady state and changed circuit conditions to determine, for example, a difference value or magnitude. If the difference exceeds a predetermined threshold a detection signal is produced and the control unit 24 sounds an alarm or operates other devices such as a radio transmitter or a recording or location indicating device.

It will be noted that any one or plurality of the modules 22, whether forming a closed perimeter as in FIG. 4 or an open ended strip of modules, may be employed to produce alarm signals by the detection of perturbations in the sensed radiation as described above.

Figure 5:
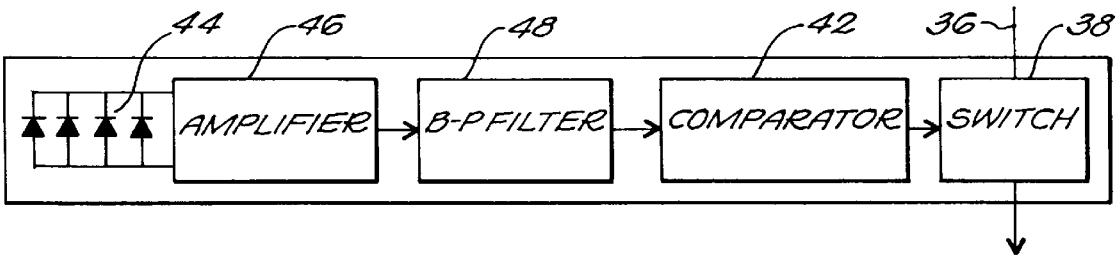
FIG. 5 is a schematic illustration showing the operative connections between the sensors and a comparator.

FIG. 5 schematically illustrates circuit elements in one form of module in the detection system of FIG. 4. In this embodiment the emitters 26 (not shown in FIG. 5) emit infrared radiation at a predetermined frequency. Diodes 44 in FIG. 5 each represent a photosensitive diode in a sensor 28. An alternating signal modulated by the diodes 44 is amplified by an amplifier 46 and filtered by a band-pass filter 48 chosen to eliminate unwanted signals, for example low frequency signals coming from fluorescent lamps. This filtering may be completed by using optical filters in front of the photosensitive diodes 44. If the difference between the steady state and changed signals exceeds a given threshold, the comparator 42 generates a signal that actuates the switch 38. The switch 38 triggers an alarm, a signal transmitter, a recorder or other device indicating the falling of the object into the water.

Mounting the strip 20 below the surface 18 of the water instead of above the surface is preferred in some cases because it reduces the triggering of the alarm caused by debris such as plastic bags, papers, etc. which normally float on the surface.

FIG. 6 illustrates two strips 20 of modules 22, one disposed above the surface 18 of the body of water 16, and one disposed below said surface. Broken lines 50 represent the horizontal. Arrows 52 represent the direction of maximum radiation intensity of directional radiation emitters 26. The arrows form small angles to the horizontal, thus minimizing the reflected energy reaching the sensors 28 from reflections at the opposing wall of the swimming pool. This results in an improvement in the sensitivity of the detection apparatus.

We claim:

1. Apparatus for detecting the fall of an object into a body of water comprising, in combination, a plurality of modules connected in consecutive sequence and adapted for extending in a horizontally extending line contiguous to said body of water, said modules comprising emitters adapted to emit radiation energy across an area of said body and radiation sensors, said emitters and sensors being disposed in an alternating sequence, and control means operatively connected to said radiation sensors and including response means having a steady state operative condition produced by sensed radiation energy in the absence of said object and a perturbed operative condition produced by sensed radiation energy including reflections from said object in said body, and a comparator connected to the response means and adapted to produce a detection signal corresponding to the difference between said normal and perturbed conditions.

2. Apparatus according to claim 1, in which said modules are adapted to be mounted around the perimeter of a swimming pool.

3. Apparatus according to claim 2, in which said modules are adapted to be mounted below the water line of said body.

4. Apparatus according to claim 2, in which said modules are adapted to be mounted above the water line of said body.

5. Apparatus according to claim 2, in which the emitters are mounted with their directions of maximum radiation intensity forming angles to the horizontal.

6. Apparatus according to claim 1, in which the emitters are adapted to emit periodic pressure waves and the sensors comprise piezoelectric plates.

7. Apparatus according to claim 1, in which the emitters are adapted to emit periodic pulses of infrared energy and the sensors are responsive to said energy.

8. Apparatus according to claim 1, in which the modules are of identical construction, each module comprising at least one emitter and at least one sensor.

* * * * *